US006986304B2

(12) United States Patent
Voulgaris

(10) Patent No.: US 6,986,304 B2
(45) Date of Patent: Jan. 17, 2006

(54) HYDRAULIC TORQUE MOTOR WITH CABLE FEEDTHROUGHS AS WELL AS A CRANE WITH SUCH A TORQUE MOTOR

(75) Inventor: Christian Voulgaris, St. Veit/Glan (AT)

(73) Assignee: Genesis Europe GmbH and Co. KG, Baienfurt/Ravensburg (DE)

( * ) Notice: Subject to any disclaimer, the term of this patent is extended or adjusted under 35 U.S.C. 154(b) by 51 days.

(21) Appl. No.: 10/612,436

(22) Filed: Jul. 1, 2003

(65) Prior Publication Data

US 2004/0131483 A1 Jul. 8, 2004

(30) Foreign Application Priority Data

Jul. 17, 2002 (DE) ..... 102 32 421

(51) Int. Cl.
*F01B 23/00* (2006.01)

(52) U.S. Cl. ..... 92/145; 418/61.3

(58) Field of Classification Search ..... 91/498, 91/485; 92/70–72, 90–92, 145; 418/61.3, 418/171

See application file for complete search history.

(56) References Cited

U.S. PATENT DOCUMENTS 3,871,983 A * 3/1975 Watts ..... 204/209
5,071,327 A * 12/1991 Brewer ..... 418/5

FOREIGN PATENT DOCUMENTS

| | | |
|---|---|---|
| DE | 42 02 466 | 8/1993 |
| DE | 43 35 678 | 4/1995 |
| DE | 195 05 585 | 8/1996 |

* cited by examiner

*Primary Examiner*—Edward K. Look
*Assistant Examiner*—Devin Hanan
(74) *Attorney, Agent, or Firm*—Jordan and Hamburg LLP

(57) ABSTRACT

A hydraulic rotating motor for the driving mechanism of electricity consumers. The rotating motor preferably has revolving working pressure chambers, which are acted upon by hydraulic fluid for producing a rotational movement, which is transferred to a driven shaft. Electricity is supplied to a consumer, through a lead which is passed from the outside into a stationary head, through an interior of the rotating motor to the consumer. In a vehicle with the motor, leads supplying electricity are passed protected within a radial arm to a head of the rotating motor and, from there, through the interior of the rotating motor to the consumer of electricity.

45 Claims, 3 Drawing Sheets

HYDRAULIC TORQUE MOTOR WITH CABLE FEEDTHROUGHS AS WELL AS A CRANE WITH SUCH A TORQUE MOTOR

BACKGROUND

The invention relates to a hydraulic rotating motor with a cable lead-through, as well as to a bagger or a crane or a turn-up machine with such a rotating motor.

Cranes, baggers or turn-up machines, especially when such vehicles or machines are mobile, are used in different areas in the sector of the transshipment of goods, the handling of scrap, wood, materials to be recycled, the demolition industry or the building industry. So that such vehicles or machines, which represent significant procurement costs for the operator, can be used for various tasks, several different tools or even multifunction heads can be mounted on their radial arms. For the different intended uses, these tools or multifunction heads must be rotatable with respect to the arm of the crane. For this purpose, hydraulic rotating motors are used, which have, for example, revolving working pressure chambers, which are supplied with hydraulic fluid consecutively in the peripheral direction by means of a distributor, so that, when acted upon by the pressure of the hydraulic fluid from the working chambers, a rotational movement results, which is transferred to the rotor and consequently to the tools connected with the rotor. A rotating motor of this type (toothed-ring construction) is described, for example, in the DR 42 02 466 C2.

In an area such as the transshipment of goods, recycling, the building industry, or scrap heaps, the conditions, under which the equipment is used, are extremely robust. For this purpose, hydraulic pipelines are placed in the arm of the vehicle or machine up to the rotating motor and continued to the tools, so that the rotational motion, as well as the motion of the tools, for example, for opening and closing scoops, can be realized hydraulically. There is also a series of tools, for which, aside from the hydraulic supply, additional cables are also required for supplying electric driving current or electric control current. For the known rotating motors and known vehicles, cranes or machines, for which such rotating motors are used, there is an external separation between the hydraulic driving mechanism and the supply of electricity. For example, for a tool in the form of an electric magnet, power cables are passed around the outside of the rotating motor to the electromagnet, which is below the rotating motor at the crane arm. In view of the robust conditions of use, damage to the external power cable cannot be excluded. However, an external power cable, which is damaged during robust use, represents great danger, for example to persons working the in the area of a scrap heap.

SUMMARY

It is therefore an object of the invention to provide a hydraulic rotating motor for driving tools at a vehicle, crane or machine, as well as a vehicle, crane or machine with such a hydraulic rotating motor, the supply leads for electrical driving mechanisms or controls of additional units or for special functions of the tools being protected, so that they cannot be damaged even under robust conditions of use and danger, for example, because of electric shock, can be avoided.

This objective is accomplished with a hydraulic rotating motor with distinguishing features including working pressure chambers which are adapted to be acted upon by hydraulic fluid for producing rotational movement, a shaft to which the rotational movement is transferred, a stationary head, electric conductors passing into the head from outside the motor and extending through an interior of the motor to the electric consumer, as well as with a vehicle with the hydraulic rotating motor for driving a consumer of electricity, especially electromagnets or multifunction heads, for which leads, protected towards the outside, and supplying electricity, are passed within a radial arm into a head of the rotating motor and, from there, through the interior of the rotating motor up to the consumer. Appropriate further developments of the inventive, hydraulic, rotating, motor are defined herein.

The rotating motor for driving tools is used particularly as a driving mechanism for moving a consumer of electricity, such as an electromagnet, which is mounted at a vehicle, machine or crane, preferable at a mobile vehicle. In a known construction, the rotating motor has working pressure chambers, which are acted upon by a hydraulic fluid, so that a driven shaft is caused to rotate. The driven shaft is connected mechanically with the tools, so that, its rotational movement is transferred to the tool. Electricity is supplied to a consumer of electricity or to a tool with a consumer of electricity by a lead, which is brought from outside into a head of the rotating motor, which is also referred to as current housing, and passed through the interior of the rotating motor to the consumer. This lead can be brought relatively easily into the head of the rotating motor if, in accordance with a first example, the head of the rotating motor is stationary. At the same time, the interior of the rotating motor is insulated from the hydraulic circuit so that, even in the event that the cable breaks, energizing of the complete motor can be avoided. From the stationary head of the rotating motor, power is supplied preferably over a brush-slip ring device through the interior of the rotating motor, preferably through the driven shaft, so that the electricity-carrying cable can emerge once again centrally from the driven shaft at its side averted from the head of the rotating motor and thus be connected with the electricity consumer. With that, it is possible, on the one hand, that current for an electricity consumer or for particular functions at a tool, which can be carried out advantageously by means of electric motors, is passed through the rotating motor. However, on the other hand, it is also possible that leads for transferring a control signal or control current for appropriate actuators, for example, at a multifunction head, are passed through the rotating motor. With that, it is ensured that, even under robust conditions of use, electricity-carrying leads, even those, which only transmit control currents or control signals, are protected in the interior of the rotating motor.

Preferably, the rotating motor is of known construction and has revolving working pressure chambers and a toothed ring construction. A rotor, present with the driven shaft, meshes with a rotor ring and forms working pressure chambers in between, the rotor and rotor ring being held between distributor plates, over which the working pressure chambers are supplied with hydraulic fluid. The working pressure chambers are supplied consecutively in the circumferential direction with hydraulic fluid.

In the stationary head, forming the current housing of the rotating motor, a cable holder, constructed as an insulator, is disposed, over which the current is passed from the brush-slip ring device through the motor. In principle, it is possible that the brushes are at the head of the rotating motor and the slip ring or rings are disposed, on the other hand, at a region of the driven shaft in the region of the head. Of course, the reverse is also possible, that is, the slip rings are disposed at the stationary head of the rotating motor and the brushes, on the other hand, are disposed at the driven shaft or connected with a portion of the driven shaft. Of course, different parts of such a brush-slip ring device or also several different such devices are provided for supplying electricity directly and for transmitting control currents or signals.

Preferably, the driven shaft, which preferably is constructed as a flanged shaft, is provided with a central borehole, so that tools can easily be connected and through which the electricity-carrying lead is passed. However, it is also possible to provide separate channels in the central region of the driven shaft of the rotating motor, so that the electricity-carrying leads are carried by such a channel or by several such channels and the leads for the control signals or control currents can be carried in different channels. It is self-evident that, in the event that the cable emerges outside of the direct, central region of the driven shaft at the side opposite to the head of the rotating motor, preferably a brush-slip ring device is to be provided. However, this depends on the particular construction of the tool or of the electricity consumer.

The use of a hydraulic rotating motor in a vehicle, a machine or a crane, which has an electric magnet, that is, a vehicle, which is used, for example, in the area of a scrap heap, is particularly preferred. In the case of such a vehicle with an inventive hydraulic rotating motor, a so-called electric motor, and an electric magnet as working tool, it is particularly advantageous, because of the extremely rough use conditions, to pass the magnet cable completely protected through the rotating motor.

Further advantages, distinguishing features and possible uses of the invention are described in detail by means of an example with reference to the attached drawing, in which

BRIEF DESCRIPTION OF THE DRAWINGS

In FIG. 1, a longitudinal section through rotating motor 100 is shown. This rotating motor 100 has a head 9, which is constructed as a current housing, a motor head 25, a rotor housing 23, a motor housing 21 as well as a driven shaft 26, which is constructed as a flanged shaft. Compared to a conventional rotating motor, which is not constructed as an electric motor, the rotating motor 100 has an upper part, which consists of two parts, namely the head 9, which is constructed as a current housing, and the motor head 25. The head 9 is bolted in the usual manner to the motor head 25 at the outer periphery of this head. An additional pin, which is not numbered, ensures that the correct positioning is ensured during the installation of the head 9 at the motor head 25.

DETAILED DESCRIPTION

Figure 1:
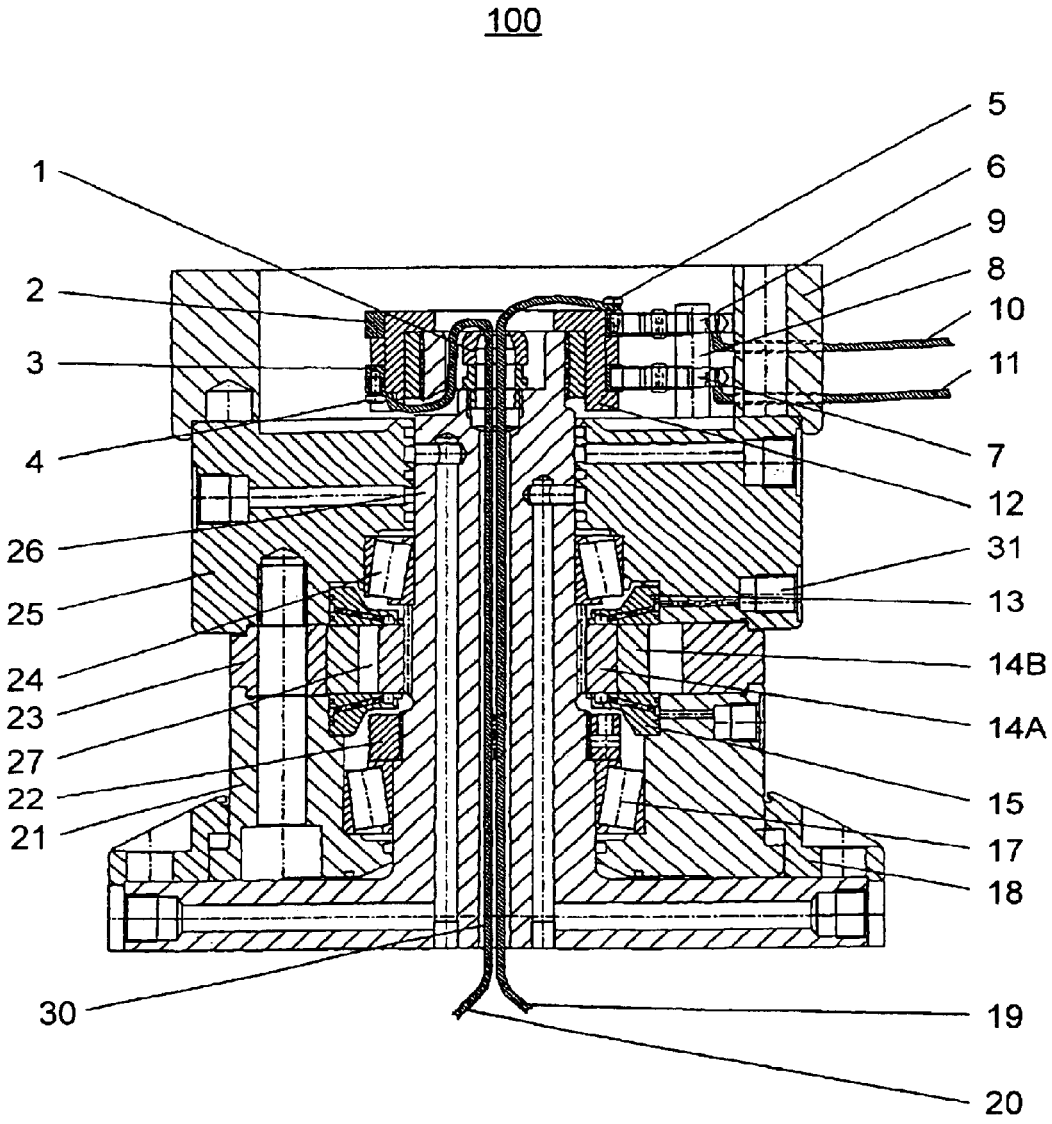
FIG. 1 shows an elongated section through hydraulic rotating motor.

The flanged shaft, which is constructed as the driven shaft 26, on the one hand, closes off the motor at the bottom and, over a thrust collar 18, offers the possibility of connecting tools, which are to be provided with hydraulic fluid. The driven shaft 26 is passed through the interior of the motor 100, that is, through the motor 100 housing 21, through the rotor housing 23 and through the motor head 25 as far as the head 9, which is constructed as the current housing. A central borehole 30 passes through the whole length of the driven shaft 26. At the end of the driven shaft 26, protruding into the head 9, a holder of U-shaped cross section is disposed that is, inverted over the end. This holder 12 is slipped on by means of a toothed arrangement on this end of the driven shaft 26; it is equally possible to screw the holder 12 onto the end of the driven shaft 26.

Slip rings 2, 3, which are formed especially from brass, are disposed on the outside of the holder. Accordingly, the holder 12 for the slip rings 2, 3, can be dismantled. The holder 12 for the slip rings 2, 3 is connected with the driven shaft 26, so that there cannot be any relative rotation.

Figure 3A:
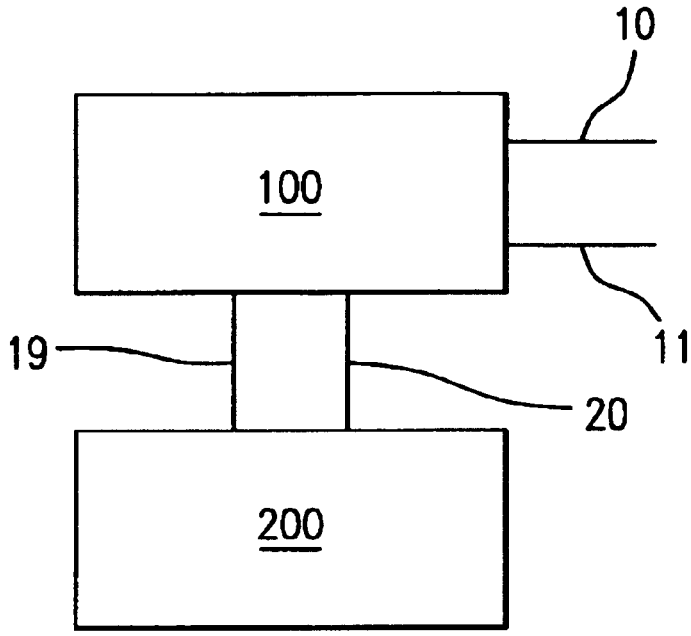
FIG. 3A is a black diagram of the rotating motor used in conjunction with an electromagnet.
Figure 3B:
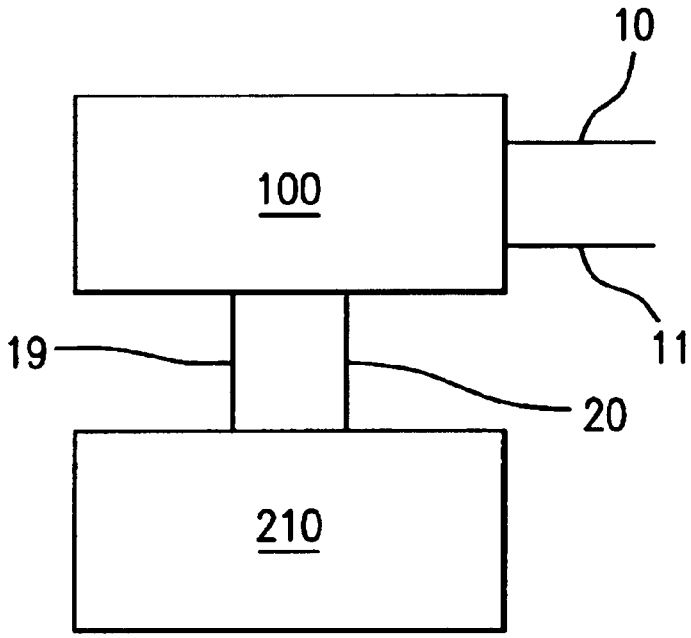
FIG. 3B is a black diagram of the rotating motor used in conjunction with a multifunctional head.

A screw 5 is provided at the slip ring 2 as connecting terminal for a first cable 19 and a screw 4 is provided at the slip ring 3 as a connecting terminal for a second cable 20. The cables 19, 20 are passed by the connecting terminals of the slip rings 2, 3 through the central borehole 30 of the driven shaft 26 and emerge in the central region of the driven shaft 26. Accordingly, the leads for an electricity consumer, formed as cables passed through the interior of the rotating motor, are protected completely towards the outside and can be passed from the central exit of the driven shaft 26 directly to the electricity consumer, without the cables being accessible to damage from outside by a robust or rough use. The electrical consumer may be an electromagnet 2000 as shown in FIG. 3A or a multifunctional head 210 as shown in FIG. 3B.

The power supply leads or control power supply leads in the rotating motor 100, which is constructed as an electric motor, extend in the head 9 through laterally produced boreholes, through which a first 10 and a second 11 power cable are passed. Both power cables 10, 11 are taken to a first double-brush holder 6 or to a second double-brush holder 7. Double-brush holder 6 as well as double-brush holder 7 are fastened to a centering device, which is constructed as a bolt 8. Each double-brush holding device 6, 7 has a brush 28, 29 at each end (see FIG. 2). The brushes 28, 29 of the double-brush holder 6, which is supplied with power by the power cable 10, are in contact with the slip ring 2. On the other hand, the brushes of the double-brush holder 7, which is supplied with power by the power cable 11, are in contact with the slip ring 3. Accordingly, power is supplied from the outside to a first consumer by the power cable 10 over first double-brush holder 6, its brushes or carbons 28, 29, the slip ring 2 and cable 19. A further consumer can be supplied over the power cable 11, the double-brush holder 7, the brushes of the latter, the slip ring 3 and the cable 20. It is, however, also possible that only a single power lead is passed through the rotating motor. Moreover, the central borehole 30 through the driven shaft 26 can be constructed so that additional, for example, control cables can be passed through it. The cables 19 and 20, connected by the respective slip ring 2, 3, are passed over a cable holder 1, which may be constructed as an insulator, into the interior of the driven shaft 26; that is, into the central borehole 30.

The rotating motor 100 itself, in a known manner, has a rotor 14 A, which is attached to the driven shaft 26 or connected to it by means of a toothed connection. This rotor is constructed as a toothed rotor, a rotor ring 14 B engaging a denticulation formed at its outer side. During the rotation of the rotor, working pressure chambers 27 are formed between the rotor 14 A and rotor ring 14 B, the rotor ring being supported in the rotor housing 23 by teeth at its outer side. Distributor plates 13, 15 are disposed above and below the rotor 14 A and the rotor ring 14 B. The working pressure chambers 27 are supplied with hydraulic fluid under pressure consecutively in the circumferential direction via the distributor plates, so that the pressure energy of the hydraulic fluid can be converted to rotational energy and the driven shaft 26 can be caused to rotate by the rotor 14 A. In this connection, the hydraulic fluid is supplied over a connection 31 over the distributor plate 13 to the working pressure chambers 27. Appropriate roller bearings are disposed above and below the respective distributor plates 13 and 14. The roller bearings are constructed as tapered roller bearings 24 or tapered roller bearings 17. Moreover, an adaptor nut for bracing or centering the driven shaft 26 in the interior of the rotating motor 100 is provided between the tapered roller bearing 17 and the lower distributor plate 15. In this example, the adaptor nut 22 is braced preferably directly on the inner bearing race of the tapered roller bearing 17.

The thrust ring 18, which is supported at the outer region of the flange of the driven shaft 26, which is constructed as a flanged shaft, is provided at the lower end of the motor housing 21 at the outer periphery of the latter. The thrust ring 18 provides a screw connection with a tool, which is to be caused to rotate by the rotating motor.

Figure 2:
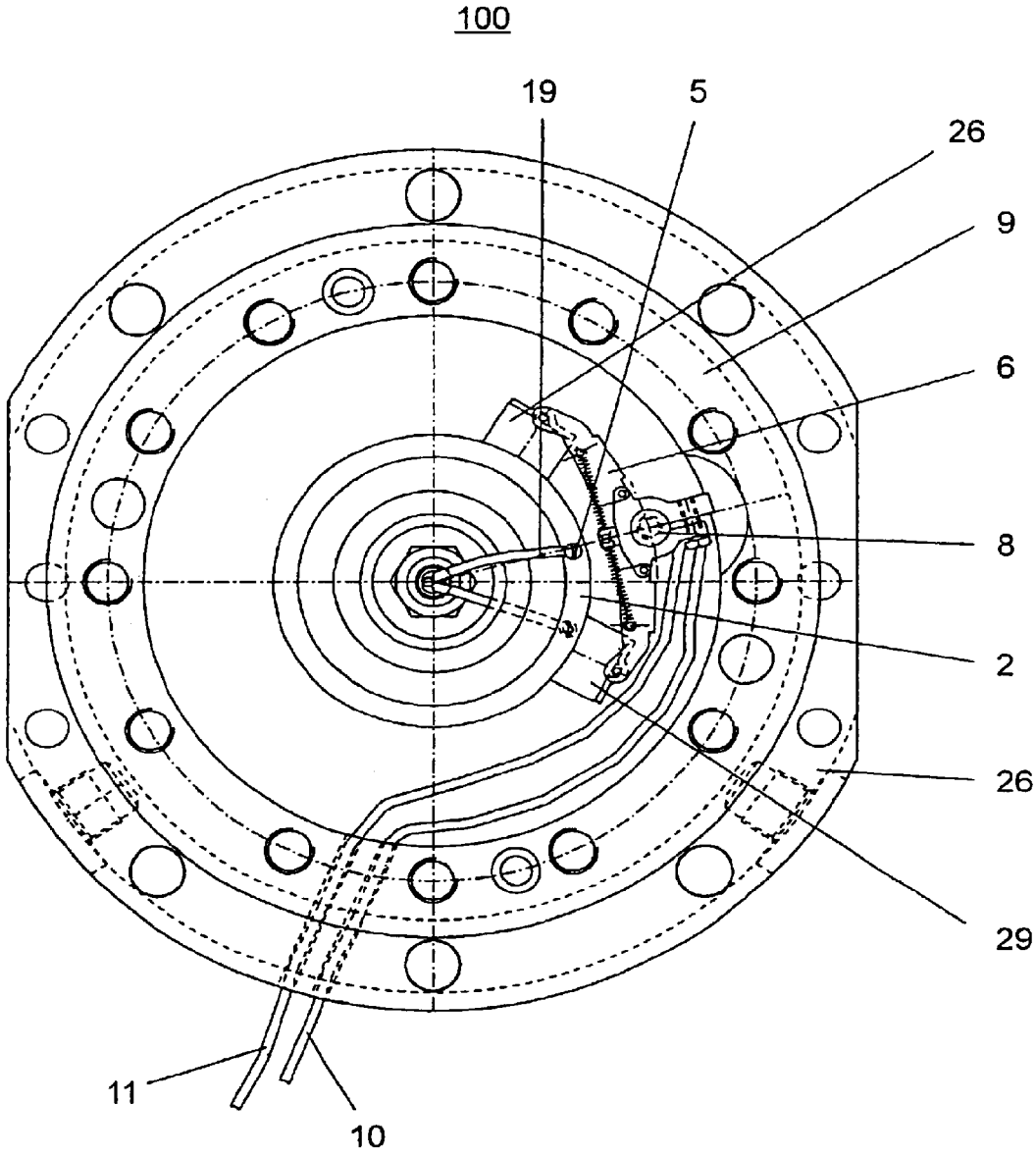
FIG. 2 shows a plan you of an opened head of the rotating motor of FIG. 1.

FIG. 2 shows a plan view of the rotating motor, which is shown opened at the top. Under use conditions, the head 9 has a lid, which covers the brush-slip ring device (2, 3, 4, 5, 6, 7, 8, 28, 29) and with that closes off the rotating motor, which is constructed as an electric motor, at the top. The power cables 10, 11 are passed into the interior of the rotating motor 100 laterally through the head. In the interior of the rotating motor, the power cable 10 is taken to the double-brush holder 6 by means of a connecting clamp, which is not labeled. The double-brush holder 6 is centered at the bolt 8, which is constructed as a centering device and at each arm-shaped end, carries a brush 28 or 29. The brushes 28, 29 are pressed by means of the force of a spring against the slip ring 2, from which the cable 19 is passed through the central borehole of the driven shaft 26 by means of the screw 5 in the form of a connecting clamp.

Of course, in the end region of the driven shaft 26, which protrudes into the region of the head 9, the slip rings can be disposed either directly on the driven shaft it is readily possible either to dispose the slip rings directly on the driven shaft, or disposed on revolving brushes, which are in contact with sliding contacts, which, over an appropriate holder, are in contact with the power cables 10, 11, which are passed from the outside into the head 9.

The electric motor 100 accordingly offers the possibility of supplying hydraulic units with hydraulic energy and of providing a rotational movement for the additional hydraulic units as well as of supplying power through the hydraulic motor 100 for electricity consumers. With that, a novel rotating motor is made available, the use of which is clearly more flexible than that of conventional rotating motors and which, in addition to the high flexibility, also provides a new degree of reliability with respect to the complete avoidance of damage to the power-carrying cables.

What is claimed is:

1. A hydraulic motor for moving an electricity consumer mounted on a switch, the motor comprising working pressure chambers which are adapted to be acted upon by hydraulic fluid for producing rotational movement, a shaft to which the rotational movement is transferred, a stationary head, electric conductors passing into the head from outside the motor and extending through an interior of the motor to the electric consumer.

2. A hydraulic motor for moving an electricity consumer mounted on a switch, the motor comprising:

working pressure chambers which are adapted to be acted upon by hydraulic fluid for producing rotational movement, a shaft to which the rotational movement is transferred, a stationary head, electric conductors passing into the head from outside the motor and extending through an interior of the motor to the electric consumer, a distributor for hydraulic fluid, the distributor comprising two plates, a rotor connected to the shaft, and a rotor ring which meshes with the rotor, and wherein the rotor, rotor ring and distributor plates form the chambers, the motor being rotated by sequential action upon the chamber in a circumferential direction by the hydraulic fluid.

3. The hydraulic motor of claim 2, wherein the electrical conductors comprise slip rings and brushes slidingly engage the slip ring.

4. The hydraulic motor of claim 3, wherein the slip rings are mounted in the head and the brushes are mounted on the shaft.

5. The hydraulic motor of claim 3, wherein the slip rings are mounted on the shaft and the brushes are mounted in the head.

6. The hydraulic motor according the claim 2, wherein the electric conductors comprise electric wire or electric cable and the electric wire or cable parts extend through the shaft in an axial direction of the shaft and emerges from the motor facing the electric consumer.

7. The hydraulic motor according to claim 6, wherein the shaft comprises a flange.

8. The hydraulic motor according to claim 2, wherein the electric consumer comprises an electromagnet and the electric conductors comprise said electric cable.

9. The hydraulic motor according to claim 2, further comprising actuators and wherein the electrical conductors comprise electric wires or cables connected to the actuators for providing control currents to the actuators.

10. The hydraulic motor according to claim 2, wherein the actuators comprise multifunction heads.

11. A vehicle having a radial arm mounted thereon and a motor of claim 2 mounted on the radial arm, and wherein the wires or cables pass within the radial arm into the head of the motor and from these through the interior of the motor and through the head to the electric consumer.

12. The hydraulic motor of claim 1, wherein the electrical conductors comprise slip rings and brushes slidingly engage the slip ring.

13. The hydraulic motor according the claim 1, wherein the electric conductors comprise electric wire or electric cable and the electric wire or cable parts exceed through the shaft in an axial direction of the shaft and emerges from the motor facing the electric consumer.

14. The hydraulic motor according to claim 1, wherein the electric consumer comprises an electromagnet and the electric conductors comprise said electric cable.

15. The hydraulic motor according to claim 1, further comprising actuators and wherein the electrical conductors comprise electric wires or cables connected to the actuators for providing control currents to the actuators.

16. The hydraulic motor according to claim 1, wherein the actuators comprise multifunction heads.

17. A vehicle having a radial arm mounted thereon and a motor of claim 1 mounted on the radial arm, and wherein the wires or cables pass within the radial arm into the head of the motor and from these through the interior of the motor and through the head to the electric consumer.

18. A hydraulic drive device for hydraulically rotating and supplying power to an electrically operated device, the device comprising:

a hydraulic motor assembly having a stationary mount end defining an mount end interior cavity and a shaft output end;

a shaft roratably mounted in the hydraulic motor assembly and having an axial shaft bore;

the shaft sequentially having a first end extending into the mount end interior cavity of the hydraulic motor assembly, a shaft body portion passing through and driven by the hydraulic motor assembly, and a second end exposed at the shaft output end of the hydraulic motor assembly;

electric input conductors passing into the mount end interior cavity from outside the hydraulic drive device;

electric supply conductors disposed in said axial shaft bore and extending from the first end of the shaft and the second end of the shaft for connection to the electrically operated device; and slip rings and brushes rotatably disposed in the mount end interior cavity and interconnecting said electric input conductors and said electric supply conductors.

19. The hydraulic drive device of claim 18 wherein the hydraulic motor assembly comprises:

a stationary head assembly defining the mount end interior cavity;

a rotor assembly mounted to the stationary head assembly and defining working pressure chambers which are adapted to be acted upon by hydraulic fluid for producing rotational movement;

a distributor for hydraulic fluid communicated with the working pressure chambers;

the rotor assembly including a rotor rotatably driving the shaft body portion, a rotor ring which meshes with the rotor, and wherein the rotor, rotor ring and distributor form the working chambers, the motor being rotated by sequential action upon the chambers in a circumferential direction by the hydraulic fluid.

20. The hydraulic drive device of claim 19, wherein the slip rings are mounted on the shaft and the brushes are mounted in the stationary head.

21. The hydraulic drive device of claim 20, wherein the electric device comprises an electromagnet.

22. The hydraulic drive device of claim 20, wherein the electric device comprises comprising actuators and wherein the electric supply conductors comprise electric wires or cables connected to the actuators for providing control currents to the actuators.

23. The hydraulic drive device of claim 22, wherein the actuators comprise multifunction heads.

24. A vehicle having a radial arm mounted thereon and the hydraulic device of claim 18 mounted on the radial arm, and wherein the electric input conductors pass within the radial arm into the hydraulic motor assembly.

25. The hydraulic drive device of claim 19, wherein the electric device comprises an electromagnet.

26. The hydraulic drive device of claim 19, wherein the electric device comprises comprising actuators and wherein the electric supply conductors comprise electric wires or cables connected to the actuators for providing control currents to the actuators.

27. The hydraulic drive device of claim 26, wherein the actuators comprise multifunction heads.

28. The hydraulic drive device of claim 18, wherein the electric device comprises an electromagnet.

29. The hydraulic drive device of claim 18, wherein the electric device comprises comprising actuators and wherein the electric supply conductors comprise electric wires or cables connected to the actuators for providing control currents to the actuators.

30. The hydraulic drive device of claim 29, wherein the actuators comprise multifunction heads.

31. The hydraulic drive device of claim 18, wherein the slip rings are mounted on the shaft and the brushes are mounted to the stationary mount end.

32. The hydraulic drive device of claim 31, wherein the electric device comprises an electromagnet.

33. The hydraulic drive device of claim 31, wherein the electric device comprises comprising actuators and wherein the electric supply conductors comprise electric wires or cables connected to the actuators for providing control currents to the actuators.

34. The hydraulic drive device of claim 33, wherein the actuators comprise multifunction heads.

35. The hydraulic drive device of claim 18, wherein the slip rings are mounted to the mount end interior cavity and the brushes are mounted on the shaft.

36. The hydraulic drive device of claim 18, further comprising:

a ring holder collar disposed on the first end of the shaft and supporting the slip rings; and the brushes being movably mounted to a surface of the mount end interior cavity.

37. The hydraulic drive device of claim 36, wherein the brushes are double brushes pivotably mounted to a surface of the mount end interior cavity.

38. The hydraulic drive device of claim 37, further comprising a conductor holder collar concentrically disposed in an end of the axial shaft bore at the first end of the shaft and supporting the electric supply conductors extending from the axial shaft bore.

39. The hydraulic drive device of claim 38, wherein the ring holder collar includes at least one radially extending hole for passing a conductor of the electric supply conductors to effect connection with a corresponding one of the slip rings.

40. The hydraulic drive device of claim 36, further comprising a conductor holder collar concentrically disposed in an end of the axial shaft bore at the first end of the shaft and supporting the electric supply conductors extending from the axial shaft bore.

41. The hydraulic drive device of claim 40, wherein the ring holder collar includes at least one radially extending hole for passing a conductor of the electric supply conductors to effect connection with a corresponding one of the slip rings.

42. The hydraulic drive device of claim 36, wherein the ring holder collar includes at least one radially extending hole for passing a conductor of the electric supply conductors to effect connection with a corresponding one of the slip rings.

43. The hydraulic drive device of claim 18, wherein the brushes are double brushes pivotably mounted to a surface of the mount end interior cavity.

44. The hydraulic drive device of claim 43, further comprising a conductor holder collar concentrically disposed in an end of the axial shaft bore at the first end of the shaft and supporting the electric supply conductors extending from the axial shaft bore.

45. The hydraulic drive device of claim 18, further comprising a conductor holder collar concentrically disposed in an end of the axial shaft bore at the first end of the shaft and supporting the electric supply conductors extending from the axial shaft bore.

* * * * *